United States Patent [19]

Mars et al.

[11] 4,274,893

[45] Jun. 23, 1981

[54] HIGH TEMPERATURE TWO COMPONENT EXPLOSIVE

[75] Inventors: James E. Mars, Vashon; Donald R. Poole, Woodinville; Eckart W. Schmidt, Bellevue, all of Wash.; Charles Wang, Lafayette, Ind.

[73] Assignee: Rocket Research Company, Redmond, Wash.

[21] Appl. No.: 23,786

[22] Filed: Mar. 26, 1979

[51] Int. Cl.[3] ..... C06B 45/00

[52] U.S. Cl. ..... 149/2; 149/21; 149/45; 149/61; 149/70; 149/74; 149/83; 149/92

[58] Field of Search ..... 149/21, 45, 61, 83, 149/70, 2, 74, 92

[56] References Cited

U.S. PATENT DOCUMENTS

| | | | |
|---|---|---|---|
| 4,128,442 | 12/1978 | Barlow | 149/83 X |
| 4,134,780 | 1/1979 | Barnett | 149/83 X |

*Primary Examiner*—Stephen J. Lechert, Jr.

*Attorney, Agent, or Firm*—Christensen, O'Connor, Johnson & Kindness

[57] ABSTRACT

A two component, high temperature, thermally stable explosive composition comprises a liquid or low melting oxidizer and a liquid or low melting organic fuel. The oxidizer and fuel in admixture are incapable of substantial spontaneous exothermic reaction at temperatures on the order of 475° K. At temperatures on the order of 475° K., the oxidizer and fuel in admixture have an activation energy of at least about 40 kcal/mol. As a result of the high activation energy, the preferred explosive compositions are nondetonable as solids at ambient temperature, and become detonable only when heated beyond the melting point. Preferable oxidizers are selected from alkali or alkaline earth metal nitrates, nitrites, perchlorates, and/or mixtures thereof. Preferred fuels are organic compounds having polar hydrophilic groups. The most preferred fuels are guanidinium nitrate, acetamide and mixtures of the two. Most preferred oxidizers are eutectic mixtures of lithium nitrate, potassium nitrate and sodium nitrate, of sodium nitrite, sodium nitrate and potassium nitrate, and of potassium nitrate, calcium nitrate and sodium nitrate.

59 Claims, No Drawings

HIGH TEMPERATURE TWO COMPONENT EXPLOSIVE

The government has rights in this invention pursuant to Contract No. EY-76-C-06-2336 awarded by the U.S. Department of Energy.

FIELD OF THE INVENTION

The present invention relates to explosive compositions, more particularly to two component explosive compositions comprising an oxidizer and a fuel that can be mixed at a remote location prior to detonation, and to two component explosive mixtures that are stable at high temperatures encountered in geological formations such as geothermal reservoirs.

BACKGROUND OF THE INVENTION

Explosive fracturing of geological formations surrounding oil and gas wells and geothermal wells is often required to release the oil and gas from the formation or to yield an adequate flow of heated fluid from a geothermal formation. Numerous single component, liquid explosives for explosive fracturing of oil or gas formations are known. Examples of single component explosives are desensitized nitroglycerine, diethylene glycol dinitrate/dinitrotoluene/trinitrotoluene, nitromethane combined with varying amounts of sensitizing additives, and nitrobenzene or nitrotoluene combined with sensitizing additives. Some of the nitromethane based explosives depend upon the addition of glass microballoons to operate reliably at the high hydrostatic pressures commonly encountered at the bottom of deep, fluid-filled wells. All these single component explosives have the common disadvantage of requiring large quantities of explosives to be stored on the earth's surface at the wellhead near operating personnel, constituting an unnecessary potential hazard. For example, if premature detonation should initiate downhole from an unforeseen cause, the detonation would propagate up through the tubing employed to transfer the explosive downhole and could cause a disastrous explosion at the wellhead, which could be injurious to both personnel and property.

The disadvantages of a single component, liquid explosive can be avoided by separating the explosive formulation into two nondetonable components. The two components, in liquid, molten or slurried form, can then be separately fed downhole and mixed at a safe distance below ground level. The two components can be mixed at the desired explosion situs, or can be mixed in a downhole mixer and then pumped to the section of the well where the geological formation is to be fractured. Then, if a premature downhole detonation should occur, the detonation cannot propagate any farther than the below ground location where the components are mixed, insuring the safety of personnel and property at the wellhead.

Well stimulation methods employing two component explosives are known. Fuel and oxidizer components for such two component explosives are also known. However, such known components are not suitable for high temperature downhole environments such as those encountered in geopressured or geothermal reservoirs. Such two component explosives are insufficiently thermally stable to be of practical value, because one or both of the components degrade at high temperatures, reducing or eliminating the explosive power of the explosive. Additionally, these prior art explosives are subject to premature detonation at the high temperatures encountered in many geological formations.

An additional problem associated with some prior art explosives is their relatively large failure diameter, which eliminates the possibility of detonating the explosive through sand filled regions commonly encountered in geothermal formations. Prior art explosives known to have a small failure diameter are incapable of withstanding the high temperatures found in geothermal wells.

Accordingly, it is a broad object of the present invention to provide two nondetonable, liquid or low melting components that can be easily mixed in liquid form at a remote location to form an explosive composition. It is a further object of the present invention to provide such a two component explosive that has the capability of withstanding high temperature environments for periods of at least 6 hours, and preferably for periods of at least 24 hours. It is a further object to provide such a two component explosive that can withstand temperatures on the order of 475° K. for at least 24 hours and can withstand temperatures of up to 560° K. for shorter periods without premature detonation or deflagration, and without significant loss of explosive power.

Further objects of the present invention are to provide such a two component explosive that is noncorrosive, nontoxic and environmentally acceptable; to provide such a two component explosive that has low mechanical shock, friction, electrostatic discharge and adiabatic compression sensitivity; to provide such a two component explosive that has a high detonation velocity and a small failure diameter; and to provide components for such an explosive that are readily available at a relatively low cost, that can be pumped downhole or otherwise transferred downhole and mixed downhole, and that are soluble in water to facilitate clean-up of equipment.

It is a further object of this invention to provide a nondetonable, solid, mixed composition that can be safely handled aboveground and that, upon lowering into the geothermal well and melting, becomes detonable when initiated by a cap, by a cap with booster, or by a cap with a shaped charge.

SUMMARY OF THE INVENTION

In accordance with the foregoing objects, and other objects that will become apparent to one of ordinary skill in the art after reading the following specification, the present invention provides a two component explosive that is a liquid at temperatures on the order of about 475° K. and that comprises a liquid or low melting oxidizer in admixture with a liquid or low melting organic fuel. The fuel and oxidizer when combined are incapable of substantial spontaneous exothermic reaction at temperatures on the order of 475° K., are capable of being and remaining a liquid or slurry at temperatures on the order of 475° K., and have an activation energy of at least about 40 kcal/mol at temperatures on the order of 475° K. Preferably, the oxidizer is selected from the group consisting of alkali or alkaline earth metal nitrates, nitrites, perchlorates, and mixtures thereof. Preferred fuels include liquid or low melting organic fuels such as fuels containing polar hydrophilic groups, which render the fuels miscible with the oxidizers. The most preferred fuels are guanidinium nitrate, acetamide, and mixtures thereof.

DETAILED DESCRIPTION OF THE INVENTION

The explosive compositions of the present invention generally comprise two components, a fuel and an oxidizer, each of which can be separately manufactured, transported and stored. The terms "oxidizer" and "fuel" are normally used herein in the singular but when used in the singular are intended respectively to encompass a plurality of oxidizers in admixture and a plurality of fuels in admixture. To form an explosive composition, the fuel and oxidizer components are mixed. When the components are combined, the explosive compositions are incapable of undergoing a spontaneous exothermic reaction to any substantial extent at temperatures on the order of 475° K. As will be appreciated when reading further in the specification, the preferred components are incapable of substantial spontaneous exothermic reaction at temperatures on the order of 500° K. or greater. Some of the most preferred explosive compositions can withstand temperatures as high as 744° K. without undergoing a substantial, spontaneous exothermic reaction. In addition, the explosive compositions of the present invention are relatively insensitive to premature detonation. It has been found that the explosive compositions of the present invention have an activation energy at temperatures on the order of 475° K. of at least about 40 kcal/mol. This relatively high activation energy renders the explosive compositions of the present invention relatively insensitive to thermal decomposition, mechanical shock, friction, electrostatic discharge, and adiabatic compression even at temperatures exceeding 475° K. Moreover, the explosive compositions of the present invention are stable at temperatures on the order of 475° K. By "stable" it is meant that the explosive compositions are not subject to premature detonation or deflagration and do not undergo significant loss of explosive power. The explosive compositions of the present invention are stable for periods of at least 24 hours at temperatures on the order of 475° K. and can withstand higher temperatures up to 560° K. or greater for shorter periods, for example of 6 hours. The explosive compositions of the present invention also have a high detonation velocity and a small failure diameter at elevated temperatures. By "small failure diameter" it is meant that the explosive compositions can be detonated in narrow capillaries or thin sheets.

An oxidizer employed as one of the two components for the explosive compositions of the present invention preferably has a high available oxygen content, is a liquid or a solid with a relatively low melting point, has a low vapor pressure and a relatively high density, is noncorrosive, and has a low toxicity. The oxidizer by itself must be nondetonable, so that it can be safely stored and handled. The oxidizer must also be easily combinable with the fuel component. It is most preferred that the oxidizer be a liquid or a low melting solid so that it can be easily pumped and mixed with a liquid or low melting fuel at a downhole location. Oxidizers meeting the foregoing criteria as well as other criteria that will be expanded upon below, comprise a low melting or liquid material selected from nitric acid, or alkali or alkaline earth metal nitrates, nitrites, perchlorates, or mixtures thereof.

Preferably, the oxidizer comprises a eutectic mixture of alkali or alkaline earth metal nitrates. Alkali or alkaline earth metal nitrites can be substituted for a portion of the nitrate mixture to achieve eutectic mixtures having lower melting points than can be obtained only with nitrates. However, the presence of nitrites in the oxidizer somewhat decreases the useful oxygen content of the oxidizer. Examples of preferred eutectic mixtures of nitrates alone and of nitrates and nitrites include: lithium nitrate, potassium nitrate and sodium nitrate; sodium nitrite, sodium nitrate and potassium nitrate; and, potassium nitrate, calcium nitrate and sodium nitrate.

Alkali or alkaline earth metal perchlorates can also be added to a eutectic nitrate or nitrate/nitrite mixture as a sensitizer. Lithium, potassium, sodium, magnesium and calcium perchlorate and mixtures thereof can all function as sensitizers for the nitrate and nitrate/nitrite mixtures. It has been found that up to 30% by weight, based on the total oxidizer, of perchlorates can be added while maintaining the overall performance of the explosive at a high level. The amount of perchlorate that can be added to the nitrate or nitrate/nitrite mixture is limited by the low solubility of the perchlorates in the nitrate or nitrate/nitrite eutectic mixtures. Amounts of perchlorate in addition to that amount which is soluble in nitrate or nitrate/nitrite mixtures can be dispersed rather than dissolved in the mixture if a gelling agent is used to prevent the perchlorate from separating from the mixture. For many applications, however, the oxidizer including the gelling agent must remain sufficiently liquid to be pumpable.

Although nitric acid has the highest usable oxygen content of all nitrates, and can be employed as the oxidizer component in accordance with the present invention, the corrosiveness and toxicity of nitric acid make it less desirable for most applications. If nitric acid is used, its vapor pressure can be lowered significantly by saturating the acid with nitrate salts of the alkali or alkaline earth metals. If nitric acid is employed as the oxidizer component, it is preferred that less than about 60% nitric acid be employed in conjunction with one of the eutectic mixtures of nitrates and/or nitrates and nitrites set forth above.

As an alternate to the nitrate and/or nitrate/nitrite oxidizers, low melting, preferably eutectic mixtures of alkali or alkaline earth metal perchlorates can be employed alone as the oxidizer component. These perchlorate salts have higher melting points than the corresponding nitrates. However, this disadvantage is offset by the higher useful oxygen content and better thermal stability of the perchlorate salts. Suitable perchlorate eutectic mixtures include those formed from lithium and sodium perchlorate; lithium and potassium perchlorate; lithium and calcium perchlorate; lithium, sodium and potassium perchlorate; lithium, sodium and calcium perchlorate; sodium, magnesium and potassium perchlorate; and/or sodium, potassium, and calcium perchlorate.

The fuel component for the explosive compositions of the present invention preferably has good thermal stability, does not prematurely react with the oxidizer, is preferably miscible with the oxidizer, has a high autoignition temperature in air, and is noncorrosive and low in toxicity. Additionally, it is preferred that the fuel be soluble in water or at least be flushable with water to facilitate clean-up of equipment after use. Organic fuels that are generally miscible with the oxidizers outlined above are those organic fuels containing polar hydrophilic groups, such as hydroxy, carboxy, carboxy ester, imido, amido, sulfone, sulfoxy, guanidinium, carboxy acid ester, ether, and nitrile groups. Preferred liquid or low melting fuels meeting the foregoing selection criteria include formamide, N,N-dimethyl formamide, N-methyl acetamide, N,N-dimethyl acetamide, dimethyl sulfoxide, melamine, a mixture of melamine and guanidinium nitrate, a mixture of melamine and acetamide, a mixture of melamine and N-methyl-2-pyrrolidone, pentaerythritol, tetrahydrothiophene-1,1-dioxide, N-methyl-2-pyrrolidone, diphenyl ether, diphenyl sulfone, diphenyl sulfoxide, triphenyl phosphate, polyphenyl ether, phthalic anhydride, phthalimide, phthalonitrile, phthalocyanine, dimethylphthalate, dibutyl phthalate, and triacetin, and mixtures thereof.

An important characteristic that all of the foregoing fuels have in common is that they do not exhibit any substantial, spontaneous, exothermic reaction in the presence of an oxidizer when heated to temperatures on the order of 475° K. Most of these fuels can be heated to temperatures of 500° K. or greater without undergoing an exothermic reaction with an oxidizer. Other fuels than those listed above can also be employed in accordance with the present invention, as long as the fuel in the presence of an oxidizer will not exhibit any substantial exothermic reaction when heated to a temperature of at least 475° K., and preferably to higher temperatures, within the range of from 500° K. to 700° K., as long as the fuel when combined with the oxidizer at elevated temperatures exhibits a relatively high activation energy, on the order of 40 kcal/mol or higher and as long as the fuel meets the other selection criteria set forth above. Fuels being considered for use in accordance with the present invention, other than those specifically listed above, must be individually tested in accordance with the procedures set forth in the examples below to determine whether they will thermally degrade at high temperatures and otherwise function in accordance with the selection criteria. There is no way to predict, for example, from chemical structure, which fuels will meet the criteria and which will not.

Although it is preferred that the fuels employed with the present invention be miscible with the oxidizer, it is permissible to employ fuels that are immiscible or only partially miscible with oxidizers. If immiscible or partially miscible fuels are employed, a gelling agent such as fumed silica can be incorporated into the fuel/oxidizer mixture to maintain the fuel in suspension with the oxidizer. Other conventional gelling agents can also be employed as long as they are thermally stable at the temperatures for which the explosive of the present invention is designed.

The most preferred fuels are guanidinium nitrate, acetamide, and mixtures thereof. When these preferred fuels are employed, it is preferred that from 70% to 99% of guanidinium nitrate be employed and that from 1% to 30% of acetamide be employed, the weight percentages being based on the total amount of fuel present in the explosive composition. The most preferred explosive composition prepared in accordance with the present invention comprises a eutectic mixture of sodium, potassium and calcium nitrate, and a mixture of about 70% by weight of guanidinium nitrate and about 30% by weight of acetamide. More particularly, it is preferred that the oxidizer comprise about 58.7% of the total explosive composition, while the balance of 41.3% is fuel. An acceptable alternate to the foregoing preferred mixture is a mixture comprising 27.07% by weight of a eutectic mixture of sodium nitrate (4.15% by weight of the total mixture), potassium nitrate (16.25% by weight of the total mixture), and calcium nitrate (16.50% by weight of the total mixture) as the oxidizer and 62.93% by weight of guanidinium nitrate as the fuel.

The oxidizer and fuel can be mixed in stoichiometric proportions balanced for complete combustion to water and either carbon dioxide or carbon monoxide. Generally, a carbon dioxide stoichiometry is preferred, but the mixture ratio may be anywhere between the CO- and $CO_2$-stoichiometric mixes.

If desired, glass or quartz microballoons, or other suitable fillers, can be combined with the explosive composition to insure detonability at the high pressures encountered in many geological formations. Additionally, finely divided metal powder, such as finely divided aluminum, can be added to the explosive mixture to increase the heat of explosion. The microballoons and metal powder can be maintained in suspension, if desired, by a gelling agent such as fumed silica.

In use, the oxidizer and fuel components of the present invention can be separately manufactured, transported and stored. Since the fuel and oxidizer components are by themselves nondetonable, the safety feature of the two component explosive is readily apparent. The explosive compositions of the present invention are especially adapted for use in fracturing geological formations, and particularly geothermal formations surrounding geothermal wells. The preferred oxidizers of the present invention are preferably either liquid or low melting solids that can easily be heated and pumped down a borehole. Likewise, the fuels that can be employed as the fuel component of the explosive compositions of the present invention are also preferably liquid or low melting solids that can easily be heated and readily pumped downhole. The fuel and oxidizer components can be pumped downhole separately, thus eliminating the possibility of a premature detonation propagating up the borehole, which could cause a catastrophic explosion at the wellhead. The preferred fuel and oxidizer components set forth above are readily miscible in a mixer that is placed downhole or can be mixed in the formation itself. For example, the oxidizer and fuel components can be simultaneously pumped down concentric pipes and run through a downhole mixer adjacent the location where the detonation is to occur. Even if a premature detonation were to occur downstream from the mixer, any ensuing explosion would not propagate up the separate flowstreams of oxidizer and fuel.

Alternatively, the fuel and oxidizer can be placed in separate compartments in a container, which can then be transferred downhole. The components can then be mixed downhole in the container to form the explosive composition. If desired, the container can have a conical indentation that when filled with the explosive composition of the present invention, forms a shaped charge to fracture the downhole formation in a desired manner. Still another alternative for emplacing the oxidizer and fuel components in a geothermal formation is to place each of the oxidizer and fuel components in separate containers aboveground. The containers can then be separately passed down the borehole, thus maintaining the fuel and oxidizer separate as they travel to the detonation location. The fuel and oxidizer in the containers can then be remotely mixed downhole and detonated.

Many of the explosive compositions of the present invention are solids at room temperature and other normally encountered ambient surface temperatures. These solid explosive compositions can be formed by heating the fuel and oxidizer components to temperatures above their melting points, thoroughly mixing the components in the liquid state and allowing the resulting mixture to solidify upon cooling. Surprisingly, it has been found that the explosive compositions that are solids at ambient temperatures, and especially the preferred fuel/oxidizer compositions (a eutectic mixture of sodium, potassium and calcium nitrate mixed either with guanidinium nitrate alone or with guanidinium nitrate and acetamide), not only have exceptional thermal stability at high temperatures, but also have unusual stability characteristics as a solid. While the compositions are detonable at temperatures above their melting point, the solid compositions were found to be nondetonable with a conventional detonator, even when combined with 450 g of a plastic bonded explosive (C-4) as a booster. This safety feature facilitates safe post-test cleanup of aboveground mixing equipment that may contain residual explosive. It also opens the way to an additional mode of emplacement in the well where the molten explosive is cast into cylindrical charges on the surface by remotely controlled operation. After the charge has cooled and solidified, it can be safely approached by the operators and transported to the well site. Only nondetonable, unmolten "explosive" thus has to be handled at the well site. Containers with the solid explosive are then lowered into the geothermal well to be stimulated. The explosive is melted by the indigenous heat of the geothermal reservoir and becomes again detonable. After allowing all explosive to melt completely, the detonator is fired to safely initiate the entire explosive charge in the hole.

A byproduct of the present invention is that the reaction products of the preferred explosive compositions of the present invention result in a strongly alkaline slag after explosion. The strongly alkaline slag can be used to advantage in geothermal formations. Thus, rather than cleaning out a well immediately after detonation of an explosive, the alkaline reaction products can be allowed to reside in the well for several days or weeks. The strongly alkaline material will solubilize some of the silicates, aluminates and borates commonly found in geothermal well deposits. Dissolution of these salts provides additional permeability in the geothermal formation. After several days or weeks, the slag and other dissolved deposits can be cleaned out of the well in a conventional manner.

EXAMPLES

The following Examples are intended to be illustrative of the invention and are intended to teach one of ordinary skill in the art how to make and use the invention. The Examples are not to be interpreted in any way as limitations upon the scope of protection granted by Letters Patent hereon. Rather than inserting tabular results after each Example, all tables have been appended to the end of the detailed description of the invention.

EXAMPLE I

The thermal stability of potential oxidizers and fuels was evaluated by heating six gram aliquots of oxidizer and fuel combined in stoichiometric quantities (stoichiometric ratio calculated for complete reaction to carbon dioxide and water). Each sample of an explosive mixture was placed in a test tube which in turn was placed in a stainless steel, flanged bomblet. A thermocouple was immersed in the sample prior to sealing the bomblet. The bomblets contained rupture discs for pressure relief should the pressure in the bomblet exceed the rating of the rupture disc. The bomblet and contents were heated to a temperature in the range of 505° K. to 533° K. and maintained at that temperature for 24 hours. The temperature sensed by the thermocouple was monitored to determine whether a spontaneous exothermic reaction occurred between the fuel and oxidizer as they were heated. Following the 24 hour heating period, the bomblets were cooled and observed for pressure build-up and were then opened. The explosive mixture was then visually observed to determine whether a chemical reaction had taken place (indicated by severe discoloration of the explosive). The explosive was also analyzed for loss of nitrate, an indication of a reduction in explosive power.

A listing of oxidizer and fuel mixtures appears in Table I, along with the results of the thermal stability test outlined above on the listed mixtures. The oxidizer identified as "HTS" is a eutectic mixture of sodium nitrite, sodium nitrate and potassium nitrate. The notation "$(LiNaK)NO_3$" is a shorthand notation for a eutectic mixture of lithium, sodium and potassium nitrate. The notation "$(NaKCa)NO_3$" is a shorthand notation for a eutectic mixture of sodium, potassium and calcium nitrate.

By reviewing the results listed in Table I, it can be seen that explosive mixtures containing guanidinium nitrate, phthalonitrile and di(n-butyl) phthalate as fuels were thermally stable enough to qualify for further testing. It will be noted that mixtures containing all of the remaining fuels, specifically glycerol, ethylene glycol, diethylene glycol and triethylene glycol, exhibited large nitrate losses, which would significantly reduce the effectiveness of the explosive. Additionally, the mixtures containing glycols and glycerol underwent significant premature chemical reaction as indicated by their brown, black or charred nature after the thermal stability test. Mixtures containing both ethylene glycol and diethylene glycol underwent a spontaneous exothermic reaction beginning at temperatures of 494° K. to 533° K., respectively, further detracting from their use as high temperature fuels. The term "exotherm" is used in the accompanying Tables as a shorthand notation for the occurrence of a spontaneous exothermic chemical reaction. From the foregoing thermal stability tests, it can be concluded that the alkane diols and glycerol are not effective as a fuel component for high temperature explosives in accordance with the present invention.

EXAMPLE II

A eutectic mixture of an oxidizer comprising approximately 40% by weight sodium nitrite, 7% by weight sodium nitrate and 53% by weight potassium nitrate and designated "HTS," was prefused and mixed with various fuels in the proportions indicated in Table II. A sodium perchlorate sensitizer was added to certain of the mixtures in the amounts indicated in Table II. One hundred grams of the explosive mixture was placed in an open pipe and heated to the temperature indicated in Table II while undergoing repeated stirring. Upon reaching the desired test temperature, the stirrer was withdrawn from the explosive mixture, and a number eight cap detonator was remotely inserted into the mixture and fired immediately upon being inserted. The force of the detonation was estimated by measuring the indentation, in millimeters, on a 6" by 6" by ⅜" steel witness plate on which the sample was resting. The depth of the indentation is indicated under the column headed "Indentation". (The explosive mixtures containing the phthalates as fuels were not completely miscible. Therefore, 2% by weight of fumed silica was added to those slightly immiscible mixtures as indicated in Table II to stabilize the emulsion formed by stirring during the time between withdrawal of the stirrer and insertion of the detonator).

Although all mixtures of fuel and oxidizer listed in Table II were found to be detonable, the inferior explosive force of the mixture containing ethylene glycol should be noted.

EXAMPLE III

A preferred eutectic oxidizer mixture comprising 11.2% by weight sodium nitrate, 44.3% potassium nitrate and 44.5% calcium nitrate and having a melting point of 406° K., designated "$(NaKCa)NO_3$" in Table III, was prefused and mixed with various fuels in the proportions indicated in Table III. The test method was identical to that described for Example II. Additionally, where the "Initiation" column indicates "Cap+C-4", 20 grams of plastic bonded explosive C-4 was wrapped around the detonator cap to assure detonation of the mixture. Fumed silica gelling agent ($SiO_2$) was added in small proportions to some of the immiscible or slightly immiscible mixtures to assure formation of stable emulsions. Under the "Indentation" column in Table III, an infinity sign indicates that a hole was sheared out of the witness plate such that indentation could no longer be measured.

The explosive mixtures exhibit large indentations as set forth in the "Indentation" column, indicating good explosive power at high temperatures for all of the fuel and oxidizer combinations listed. Since only high explosives with high detonation velocities are capable of shearing a hole out of a ⅜" thick witness plate, it is observed that the mixtures containing guanidinium nitrate and acetamide are especially effective.

EXAMPLE IV

Sodium perchlorate was used as a model substance for low melting binary or ternary eutectic perchlorate mixtures such as those formed from 86% by weight lithium perchlorate and sodium perchlorate (melting point 404° K.); 89% lithium perchlorate and 11% potassium perchlorate (melting point 419° K.); 74.8% lithium perchlorate and 25.2% calcium perchlorate (melting point 501° K.); lithium perchlorate, sodium perchlorate and potassium perchlorate; 57.0% lithium perchlorate, 21.6% sodium perchlorate and 21.4% calcium perchlorate (melting point 475° K.); and other perchlorate eutectic mixtures such as sodium perchlorate, magnesium perchlorate and potassium perchlorate or sodium perchlorate, potassium perchlorate and calcium perchlorate. It is expected that eutectic perchlorates will behave similarly to the sodium perchlorate oxidizer used in this Example.

Sodium perchlorate or sodium perchlorate monohydrate was mixed with fuels in the proportions shown in Table IV. The test method was identical to that described in Example III. In the test in which the monohydrate form of the perchlorate was used, it is assumed that most of the water of crystallization evaporated by the time the test temperature was reached. However, traces of water may have remained in the mixture at the time it was detonated. All mixtures listed in Table IV detonated successfully, indicating that the perchlorates can function as oxidizers in accordance with the present invention.

EXAMPLE V

Several of the explosive mixtures tested in Examples II through IV included fuels with very high vapor pressures at the test temperatures of between 505° K. and 561° K. It was thought that some fuel might have lost by evaporation during the heatup period since the test of Examples II through IV were conducted in open pipes. Several of the tests were therefore repeated in sealed pipe bombs. The sealed pipe bombs comprised pipe sections with threaded ends engaged by threaded end caps. Initiation was achieved from the outside by aiming a shaped charge, located outside the pipe and containing 13 g of RDX explosive, at the surface of the molten sample. The results are summarized in Table V. A "positive" result listed in Table V indicates the mixture was detonable.

EXAMPLE VI

In the tests described in Examples II through V, the explosive mixture was detonated as soon as practicable after the desired test temperature had been attained. Under actual conditions of use in connection with geothermal formation fracture, the first increment of explosive loaded into the well would be exposed to a high temperature for several hours until the loading operation is finished. Throughout the high temperature exposure period, the explosive must not detonate prematurely and yet must retain its detonability. Using the same sealed pipe bomb as described in Example V, the explosive mixtures listed in Table VI were mounted on a remotely operated sample shaker and were shaken and remixed for 5 minutes every 30 minutes throughout a 21 to 24 hour heating period preceding detonation on command. Throughout the duration of the heating period, the temperature of the explosive mixtures was held within ±10° K. of the desired test temperature, indicated in Table VI. Fluctuations in temperature were caused by intermittent shaking of the pipe bomb to mix the components and by changing weather conditions in the open test area. At the end of the heating period, the mixtures were remotely detonated.

The explosive mixtures containing acetamide, sulfolane, guanidinium nitrate ($GuNO_3$), or mixtures thereof listed in Table VI detonated on command following the heating period indicated.

EXAMPLE VII

While the temperature in the tests of Example VI were raised to a predetermined level and then maintained at that level as accurately as possible for a predetermined period, it was also of interest to know the upper temperature limit the explosives under test could withstand. This was determined by a series of cook-off tests described in this Example. Using the same experimental procedure exploying sealed pipe bombs mounted on a remote sample shaker as employed in Example VI, explosive mixtures were heated with an electric resistance heater until destruction by thermal decomposition of the explosive mixture inside the pipe occurred. The results are summarized in Table VII. Only one of the samples deflagrated and bulged the pipe. The damage to all other pipe bombs was similar to a hydraulic failure in that the threads of the end cap were stripped or the pipe burst. Also listed in Table VII are the temperatures at which the onset of an exothermic reaction (exotherm) occurred. From these test results, one may conclude that, in the small sample size tested, most of the explosive compositions will not detonate upon thermal initiation. Since the temperature at which a runaway reaction begins is dependent on the size of the sample, larger well bore charges may exhibit thermal degradation of temperatures somewhat below the temperatures listed in Table VII.

The last test listed in Table VII simulates downhole conditions in a geothermal well. The downhole conditions were simulated by combining finely pulverized, relatively inert minerals (graywacke) removed from a geothermal well with the explosive mixture. The minerals had no effect on the cook-off temperature of the explosive mixture.

All of the explosive mixtures listed in Table VII were stable at temperatures up to 511° K. and some were stable at temperatures up to as high as 744° K.

EXAMPLE VIII

The detonation velocities of three explosive mixtures were determined in 37 mm diameter steel pipes, 0.3 m long, with four detonation probes at an equal spacing of 76 mm. For each test, the pipe was filled with the explosive mixture listed in Table VIII. The detonation probes were connected to an array of digital time interval counters and a back-up set of raster oscilloscopes with cameras attached. The detonation velocity could be calculated from the time interval required for the detonation wave to proceed from one probe to the other and the known distance between probes. The test on the explosive mixture containing guanidinium nitrate and acetamide was repeated three times. The tests on the remaining two mixtures were repeated three times and the results averaged. The results are shown in Table VIII. The $(NaKCa)NO_3$/guanidinium nitrate/acetamide explosive detonated reproducibly in three repetitive tests at high order. There were some mixing problems with the tests using acetamide only as fuel and the low detonation velocity may be the result of incomplete mixing. The mixture with sulfolane fuel has a high order detonation capability because it bootstrapped itself to a terminal detonation velocity of 5,562 m/s in spite of the fact that the detonator/booster had accidentally not been fully inserted into the mixture.

EXAMPLE IX

The ability of a downhole mixer to serve as a detonation arrestor of an unintended premature detonation initiating downhole during the loading procedure was demonstrated in a full scale test. An acceptor section consisted of a 36 mm diameter steel pipe filled with a 70:30 mixture of molten guanidinium nitrate and acetamide surrounded by a 75 mm pipe containing molten $(NaKCa)NO_3$. The donor section consisted of a 75 mm diameter steel pipe containing 4.2 kg of the mixed high temperature explosive made from 56.5% $(NaKCa)NO_3$, 27.8% guanidinium nitrate and 15.7% acetamide. The donor and acceptor sections were close coupled without ullage. A thin steel shim at the dividing interface prevented premature mixing of the ingredients. The entire assembly was heated to 505° K., at which temperature detonation was initiated by a number eight cap surrounded by 20 g C-4 booster. The entire donor section disintegrated as the result of the high order detonation. However, the detonation did not propagate into the concentric pipes containing the unmixed ingredients, indicating that the detonation will not propogate up a well as long as the fuel and oxidizer are maintained in separate flow streams.

EXAMPLE X

Very small samples (approximately 10 milligrams) of uniformly melted explosive mixtures were sealed in aluminum sample holder cups, placed into a Perkin-Elmer DSC-1 differential scanning colorimeter and heated from room temperature to 773° K. at a rate of 20° K./minute while simultaneously monitoring the heat produced by any spontaneous exothermic reactions, referred to as exotherms. The heat produced by the heated samples was graphed versus time. From the slope of the exotherm peak, the energy of activation was determined as described by R. N. Rogers in *ANALYTICAL CHEMISTRY*, Vol. 38, No. 3, pp. 412–414 (March 1966). A mixture consisting of 6.57% sodium nitrate, 26.0% potassium nitrate, 26.12% calcium nitrate, 28.92% guanidinium nitrate and 12.39% acetamide had an activation energy of 54 kcal/mol and exhibited onset of an exotherm at 550° K., while the maximum of the exotherm occurred at 610°K. A similar formulation without acetamide had an activation energy of 189 kcal/mol, an onset of exotherm at 590° K., and an exotherm maximum at 620° K.

By comparison, explosives described in the prior art containing ethylene glycol as the fuel component, with inorganic nitrate oxidizers, had activation energies of 37 kcal/mol or less. Exotherms in such mixtures occurred at much lower temperatures, with exotherm onset at 454° K. and maximum exotherm at 489° K. The low energy of activation of mixtures containing glycol type fuels indicates an instability, and therefore lack of utility, at temperatures above 475° K., and especially above 500° K.

EXAMPLE XI 18.16 kg of a two-component explosive consisting of 56.6% $(NaKCa)NO_3$, 27.8% guanidinium nitrate and 15.7% acetamide were combined and heated above the melting point to achieve uniform mixing. Thereafter the mixture was allowed to cool to ambient temperature and solidify in a 159 mm internal diameter aluminum tube with a 12 mm wall thickness. After cooling, a booster charge consisting of 450 g plastic bonded explosive (C-4) and two 100 g pentolite pellets were placed on top of and in intimate contact with the solidified material. As expected (based on previous smaller diameter tests), the solid material failed to detonate and was thus proven safe for aboveground handling.

The present invention has been described in relation to a preferred embodiment and several alternates thereto. In addition to specific examples, the invention has also been broadly described and defined so that one of ordinary skill in the art will be able to effect various changes, substitutions of equivalents, and other alterations without departing from the broad concepts disclosed. It is therefore intended that the protection granted by Letters Patent hereon be limited only by the definition contained in the appended claims and equivalents thereof.

TABLE I

Thermal Stability Testing of Candidate Explosives

| Oxidizer | Fuel | Visual Appearance | Pressure Buildup* | Nitrate Loss, % Relative | Remarks |
|---|---|---|---|---|---|
| HTS | Ethylene glycol | Charred | + | 34 | Exotherm at 494° K. |
| HTS | Glycerol | Charred | + | | |
| HTS | Diethylene glycol | Charred | Rupture disc burst | 40 | Exotherm at 553° K. |
| HTS | Guanidinium nitrate | Unchanged | Very little | 8 | |
| $(LiNaK)NO_3$ | Ethylene glycol | Black residue | + | 28 | |
| $(LiNaK)NO_3$ | Guanidinium nitrate | Few orange spots | None | 21 | |
| $(NaKCa)NO_3$ | Ethylene glycol | Brown liquid | | 32 | |
| $(NaKCa)NO_3$ | Triethylene glycol | Black residue | + | 43 | |
| $(NaKCa)NO_3$ | Guanidinium nitrate | Orange tint, White solids | None | 12 | |
| $(NaKCa)NO_3$ | Phthalonitrile | Brown solids | + | 7 | |
| $(NaKCa)NO_3$ | Phthalimid | Yellow | | 13 | |
| $(NaKCa)NO_3$ | Di (n-butyl) phthalate | Black and yellow | | 10 | |
| $NaClO_4$ $(NaKCa)NO_3$ | Guanidinium nitrate | Beige solids | | — | Very little change |
| alone | None | Unchanged | | 16 | |

*The "+" symbol indicates that pressurized gases were released upon opening the bomblet.

TABLE II

HTS Oxidizer Tests

| HTS, g | $NaClO_4$, g | Fuel | g | Silica, g | Temperature °K. | Initiation | Indentation mm |
|---|---|---|---|---|---|---|---|
| 66.4 | 0 | Melamine | 33.6 | 0 | 561 | Cap | 10 |
| 70 | 7.4 | Dibutyl (n-butyl) phthalate | 22.6 | 2 | 533 | Cap | 9 |
| 70.1 | 0 | Dimethyl phthalate | 29.9 | 2 | 550 | Cap | 7 |
| 66.6 | 0 | Ethylene glycol | 33.6 | 0 | 466 | Cap | 3 |

TABLE III $(NaKCa)NO_3$ Oxidizer Tests

| $(NaKCa)NO_3$, g | $NaClO_4$, g | Fuel | Fuel, g | Silica, g | Temperature °K. | Initiation | Indentation mm |
|---|---|---|---|---|---|---|---|
| 386 | 0 | Acetamide | 152 | 0 | 480 | Cap + C-4 | 37 |
| 37.1 | 0 | Guanidinium nitrate | 62.9 | 0 | 561 | Cap | ∞ |
| 484 | 0 | 288g guanidinium nitrate mixed with 158g acetamide | 446 | 0 | 505 | Cap + C-4 | ∞ |
| 69.7 | 0 | Tetrahydro-thiophene-1,1-dioxide | 28.2 | 2.1 | 533 | Cap | 28 |
| 65.7 | 0 | Triphenyl phosphate | 24 | 2 | 533 | Cap | 17 |
| 60.5 | 0 | Dibutyl phthalate | 22 | 2 | 561 | Cap | 14 |

TABLE IV

Sodium Perchlorate Oxidizer

| $NaClO_4$, g | $NaClO_4 \times H_2O$, g | Fuel | Fuel, g | Temperature °K. | Initiation | Indentation mm |
|---|---|---|---|---|---|---|
| 20 | — | Guanidinium nitrate | 80 | 561 | Cap + C-4 | ∞ |
| 20 | — | Guanidinium nitrate | 80 | 561 | Cap | 17 |
| — | 67.6 | Acetamide | 32.4 | 505 | Cap | 13 |

TABLE V

Detonation Test Results - Sealed Pipe

| Oxidizer, g | Fuel, g | Temperature °K. | Result |
|---|---|---|---|
| $NaClO_4$, 20 | Guanidinium nitrate, 80 | 550 | Positive |
| $(NaKCa)NO_3$, 141 | Dimethylformamide, 34 | 511 | Positive |
| $(NaKCa)NO_3$, 135 | Acetamide, 40 | 516 | Positive |
| $(NaKCa)NO_3$, 140 | Phthalimide, 35 | 533 | Positive |

TABLE VI

24 Hour Detonation Test Results

| Sample | Test Temperature °K. | Duration Hours |
|---|---|---|
| 135g $(NaKCa)NO_3$ + 40g acetamide | 491 ± 10 | 23 |
| 136.8g $(NaKCa)NO_3$ + 38.2g sulfonlane | 491 ± 10 | 21 |
| 33.4g $NaClO_4$ + 66.6g $GuNO_3$ | 533 ± 10 | 24 |
| 135g $(NaKCa)NO_3$ + 60g acetamide | 561 ± 10 | 24 |
| 33.4g $NaClO_4$ + 66.6g $GuNO_3$ | 561 ± 10 | 24 |
| 65g $(NaKCa)NO_3$ + 90g $GuNO_3$ | 561 ± 10 | 24 |
| 88g $(NaKCa)NO_3$ + 43g $GuNO_3$ + acetamide | 505 ± 10 | 24 |

TABLE VII

Cook-Off Test Results

| Sample | Average Heating Rate °K./min | Result | Exotherm °K. |
|---|---|---|---|
| 135g (NaKCa)$NO_3$ + 60g acetamide | 5.1 | Blew top at 639° K. | 586 |
| 140g (NaKCa)$NO_3$ + 35g phthalimide + 3g $SiO_2$ | 5.6 | Blew top at 575° K. | 537 |
| 137g (NaKCa)$NO_3$ + 38g sulfolane + 2g $SiO_2$ | 7.5 | Deflagrated at 585° K. | 543 |
| 141g (NaKCa)$NO_3$ + 34g dimethylformamide + 3g $SiO_2$ | 6.4 | Blew top at 525° K. | 516 |
| 144g (NaKCa)$NO_3$ + 31g triphenylphosphate + 2g $SiO_2$ | 6.5 | Blew top at 581° K. | 553 |
| 33.3g ($NaClO_4$ + 66.7g guanidinium nitrate | 3.0 | Blew top at 744° K. | 563 |
| 145g (NaKCa)$NO_3$ + 30g N-methyl-2-pyrrolidone + 2g $SiO_2$ | 6.2 | Pipe burst at 511° K. | 505 |
| 56g (NaKCa)$NO_3$ + 94g guanidinium nitrate | 2.8 | Pipe burst at 691° K. | 585 |
| 88g (NaKCa)$NO_3$ + 43g guanidinium nitrate + 19g acetamide | 3.0 | Pipe burst at 592° K. | 568 |
| 89g (NaKCa)$NO_3$ + 40 g acetamide + 10g unidentified graywacke | 5.0 | Pipe burst at 629° K. | 555 |

TABLE VIII

Detonation Velocity Results

| Explosive | Average Detonation Velocity Results, m/s | Remarks |
|---|---|---|
| 497g (NaKCa)$NO_3$ + 245g guanidinium nitrate + 138g acetamide | 6,096 | — |
| 497g (NaKCa)$NO_3$ + 245g guanidinium nitrate + 138g accetamide | 6,016 | Mixing problems |
| 497g (NaKCa)$NO_3$ + 245g guanidinium nitrate + 138g acetamide | 6,000 | — |
| 651.2g (NaKCa)$NO_3$ + 299g acetamide | 3,810 | Mixing problems |
| 660g (NaKCa)NO + 220g sulfolane | 2,454 to 5,562 | Detonator not fully inserted. Air gap. |

The embodiments of the invention in which an exclusive property or privilege is claimed are defined as follows:

1. A high temperature, thermally stable explosive composition comprising:

a low melting oxidizer selected from the group consisting of nitric acid, alkali or alkaline earth metal nitrates, nitrites, perchlorates and mixtures thereof, a liquid or low melting organic fuel, said fuel and said oxidizer in admixture being thermally stable at temperatures on the order of 475° K. and having a relatively high energy of activation at temperatures on the order of 475° K.

2. The explosive composition of claim 1 wherein said fuel and said oxidizer in admixture are thermally stable at temperatures on the order of 500° K.

3. The explosive composition of claim 1 wherein said fuel and said oxidizer in admixture have an energy of activation of at least 40 kcal/mol at temperatures on the order of 475° K.

4. The explosive composition of claim 1 wherein said fuel and said oxidizer in admixture do not spontaneously exothermically react at a temperature of about 500° K.

5. The explosive composition of claim 1 wherein said oxidizer and said fuel are miscible.

6. The explosive composition of claim 1 wherein said fuel contains polar hydrophilic groups.

7. The explosive composition of claim 6 wherein said polar hydrophilic groups are selected from the group consisting of hydroxy, carboxy, carboxy ester, imido, amido, sulfone, sulfoxy, guanidinium, carboxy acid ester, ether and nitrile groups.

8. The explosive composition of claim 1 wherein said oxidizer and said fuel are at least partially immiscible, said explosive composition further comprising a gelling agent to inhibit separation of said oxidizer and said fuel upon standing.

9. The explosive composition of claim 8 wherein said gelling agent is fumed silica.

10. The explosive composition of claims 1, 5 or 8 further comprising a metal powder added to said oxidizer and to said fuel to increase the heat of explosion thereof.

11. The explosive composition of claim 10 further comprising a gelling agent to prevent the metal powder from separating upon standing.

12. The explosive composition of claim 11 wherein said gelling agent is fumed silica.

13. The explosive composition of claims 1, 5 or 8 further comprising glass or quartz microballoons to enhance detonability under high pressure.

14. The explosive composition of claim 13 further comprising a gelling agent to maintain said microballoons in suspension.

15. The explosive composition of claim 14 wherein said gelling agent is fumed silica.

16. The explosive composition of claim 1 wherein said oxidizer is selected from low melting mixtures of the group consisting of lithium, sodium, potassium, magnesium, and calcium perchlorate, and mixtures thereof.

17. The explosive composition of claim 1 wherein said oxidizer is selected from the group consisting of a eutectic mixture of lithium nitrate, potassium nitrate, and sodium nitrate; a eutectic mixture of sodium nitrite, sodium nitrate and potassium nitrate; and a eutectic mixture of potassium nitrate, calcium nitrate and sodium nitrate.

18. The explosive composition of claim 17 wherein said oxidizer further comprises up to about 30% by weight based on the initial oxidizer present in said explosive composition of a member of the group consisting of lithium, sodium, potassium, magnesium, calcium perchlorate, and mixtures thereof.

19. The explosive composition of claims 3, 4, 5, 8, 16, 17 or 18 wherein said fuel is selected from the group consisting of acetamide, guanidinium nitrate, and mixtures thereof.

20. The explosive composition of claim 19 wherein said fuel comprises a mixture of from 70% to 99% of guanidinium nitrate and from 1% to 30% acetamide, the weight percentages being based on the total amount of fuel present in said explosive composition.

21. The explosive composition of claim 19 wherein said oxidizer is a eutectic mixture of sodium, potassium, and calcium nitrates, and said fuel is a mixture of about 70% by weight of guanidinium nitrate and about 30% by weight acetamide, said weight percentages herein based upon the total amount of fuel present in said explosive composition.

22. The explosive composition of claim 21 wherein said oxidizer comprises about 58.7% by weight of the total oxidizer and fuel present in said explosive composition and wherein said fuel comprises about 41.3% by weight of the total oxidizer and fuel present in said explosive composition.

23. The explosive composition of claim 22 further comprising sodium perchlorate present in an amount up to about 30% by weight based on the inital amount of oxidizer present in said explosive composition.

24. The explosive composition of claims 1, 3, 4, 5, 8, 16, 17 or 18 wherein said fuel is selected from the group consisting of formamide, N,N-dimethyl formamide, N-methyl acetamide, N,N-dimethyl acetamide, dimethyl sulfoxide, melamine, a mixture of melamine and guanidinium nitrate, a mixture of melamine and acetamide, a mixture of melamine and N-methyl-2-pyrrolidone, pentaerythritol, tetrahydrothiophene-1,1-dioxide, N-methyl-2-pyrrolidone, diphenyl ether, diphenyl sulfone, diphenyl sulfoxide, triphenyl phosphate, polyphenyl ether, phthalic anhydride, phthalimide, phthalonitrile, phthalocyanine, a mixture of phthalonitrile and phthalocyanine, dimethylphthalate, dibutyl phthalate, triacetin, and mixtures thereof.

25. The explosive of claims 1, 17 or 18, wherein said explosive composition is a solid and is nondetonable at ambient temperatures and is detonable when heated to temperatures above the melting point of said composition.

26. A method for emplacing an explosive in a borehole comprising the steps of:

separately passing a low melting oxidizer and a liquid or low melting organic fuel down said borehole, said oxidizer being selected from the group consisting of nitric acid, alkali or alkaline earth metal nitrates, perchlorates and mixtures thereof, said fuel and said oxidizer in admixture being thermally stable at temperatures on the order of 475° K. and having a relatively high energy of activation at temperatures on the order of 475° K., mixing said oxidizer and said fuel downhole to form a detonable mixture, and detonating said mixture.

27. The method of claim 26, wherein said oxidizer and said fuel are separately pumped down said borehole.

28. The method of claim 26, wherein said oxidizer and said fuel are placed in containers aboveground and passed separately down said borehole.

29. The method of claim 26, wherein said borehole communicates with a geothermal formation.

30. The method of claim 26, wherein the reaction products formed by detonation of said mixture are alkaline, the method further comprising the step of allowing said products to remain in said geothermal formation for a substantial period of time after said mixture is detonated.

31. The method of claim 26, wherein a container having at least one conical indentation is first emplaced in said borehole, said oxidizer and said fuel then being separately passed down said borehole and mixed in said container before detonation.

32. A method for emplacing an explosive in a borehole comprising the steps of:

mixing and melting a liquid or low melting organic fuel and a low melting oxidizer to form a mixture, said oxidizer being selected from the group consisting of nitric acid, alkali or alkaline earth metal nitrates, perchlorates and mixtures thereof, said fuel and said oxidizer in admixture being thermally stable at temperatures on the order of 475° K. and having a relatively high energy of activation at temperatures on the order of 475° K., allowing said mixture to solidify to form a solid, nondetonable, material, passing said material down said borehole wherein indigenous heat remelts said mixture to form a detonable composition.

33. The method of claim 32, wherein said borehole communicates with a geothermal formation.

34. The method of claim 32, wherein the reaction products formed by detonation of said mixture are alkaline, the method further comprising allowing said products to remain in said geothermal formation for a substantial period of time after said mixture is detonated.

35. The method of claim 32, wherein said material is placed in a container having at least one conical indentation, and then passed down said borehole in said container.

36. A method of using an explosive composition comprising the steps of combining a low melting oxidizer and a liquid or low melting organic fuel to form a detonable mixture, said oxidizer being selected from the group consisting of nitric acid, alkali or alkaline earth metal nitrates, perchlorates and mixtures thereof, said fuel and said oxidizer in admixture being thermally stable at temperatures on the order of 475° K. and having a relatively high energy of activation at temperatures on the order of 475° K., allowing the temperature of said mixture to rise to greater than 475° K., and detonating said mixture.

37. A high temperature, thermally stable explosive composition comprising a low melting oxidizer in admixture with liquid or low melting organic fuel, said oxidizer and fuel being incapable of substantial, spontaneous exothermic reaction at temperatures on the order of 475° K., and having an activation energy of at least 40 kcal/mol.

38. The explosive composition of claim 37 wherein said oxidizer and said fuel in admixture are incapable of substantial, spontaneous, exothermic reaction at temperatures on the order of 500° K. and have an activation energy at temperatures on the order of 500° K. of at least about 40 kcal/mol.

39. The method of claim 26 wherein said fuel and said oxidizer in admixture have an energy of activation of at least 40 kcal/mol at temperatures on the order of 475° K.

40. The method of claim 26 wherein said fuel and said oxidizer in admixture do not spontaneously exothermically react at a temperature of about 500° K.

41. The method of claim 26 wherein said oxidizer is selected from low melting mixtures of the group consisting of lithium, sodium, potassium, magnesium, and calcium perchlorate, and mixtures thereof.

42. The method of claim 26 wherein said oxidizer is selected from the group consisting of a eutectic mixture of lithium nitrate, potassium nitrate, and sodium nitrate; a eutectic mixture of sodium nitrite, sodium nitrate, and potassium nitrate; and a eutectic mixture of potassium nitrate, calcium nitrate, and sodium nitrate.

43. The method of claim 26 wherein said oxidizer further comprises up to about 30% by weight based on the initial oxidizer present in said explosive composition of a member of the group consisting of lithium, sodium, potassium, magnesium, calcium, perchlorate, and mixtures thereof.

44. The method of claim 41 wherein said fuel is selected from the group consisting of acetamide, guanidinium nitrate, and mixtures thereof.

45. The method of claim 42 wherein said fuel is selected from the group consisting of acetamide, guanidinium nitrate, and mixtures thereof.

46. The method of claim 32 wherein said fuel and said oxidizer in admixture have an energy of activation of at least 40 kcal/mol at temperatures on the order of 475° K.

47. The method of claim 32 wherein said fuel and said oxidizer in admixture do not spontaneously exothermically react at a temperature of about 500° K.

48. The method of claim 32 wherein said oxidizer is selected from low melting mixtures of the group consisting of lithium, sodium, potassium, magnesium, and calcium perchlorate and mixtures thereof.

49. The method of claim 32 wherein said oxidizer is selected from the group consisting of a eutectic mixture of lithium nitrate, potassium nitrate, and sodium nitrate; a eutectic mixture of sodium nitrite, sodium nitrate, and potassium nitrate; and a eutectic mixture of potassium nitrate, calcium nitrate, and sodium nitrate.

50. The method of claim 32 wherein said oxidizer further comprises up to about 30% by weight based on the initial oxidizer present in said explosive composition of a member of the group consisting of lithium, sodium, potassium, magnesium, calcium perchlorate, and mixtures thereof.

51. The method of claim 48 wherein said fuel is selected from the group consisting of acetamide, guanidinium nitrate, and mixtures thereof.

52. The method of claim 49 wherein said fuel is selected from the group consisting of acetamide, guanidinium nitrate, and mixtures thereof.

53. The method of claim 36 wherein said fuel and said oxidizer in admixture have an energy of activation of at least 40 kcal/mol at temperatures on the order of 475° K.

54. The method of claim 36 wherein said fuel and said oxidizer in admixture do not spontaneously exothermically react at a temperature of about 500° K.

55. The method of claim 36 wherein said oxidizer is selected from low melting mixtures of the group consisting of lithium, sodium, potassium, magnesium, and calcium perchlorate, and mixtures thereof.

56. The method of claim 36 wherein said oxidizer is selected from the group consisting of a eutectic mixture of lithium nitrate, potassium nitrate, and sodium nitrate; a eutectic mixture of sodium nitrite, sodium nitrate, and potassium nitrate; and a eutectic mixture of potassium nitrate, calcium nitrate, and sodium nitrate.

57. The method of claim 36 wherein said oxidizer further comprises up to about 30% by weight based on the initial oxidizer present in said explosive composition of a member of the group consisting of lithium, sodium, potassium, magnesium, calcium perchlorate, and mixtures thereof.

58. The method of claim 55 wherein said fuel is selected from the group consisting of acetamide, guanidinium nitrate, and mixtures thereof.

59. The method of claim 56 wherein said fuel is selected from the group consisting of acetamide, guanidinium nitrate, and mixtures thereof.

* * * * *

UNITED STATES PATENT AND TRADEMARK OFFICE

CERTIFICATE OF CORRECTION

PATENT NO. : 4,274,893

DATED : June 23, 1981

INVENTOR(S) : Mars et al.

It is certified that error appears in the above-identified patent and that said Letters Patent are hereby corrected as shown below:

| | | | |
|---|---|---|---|
| Claim 27, | Column 17, | Line 53 | After the numeral "26" insert: --41, 42, 43, 44, 45, 46, or 47-- |
| Claim 28, | Column 17, | Line 56 | After the numeral "26" insert: --41, 42, 43, 44, 45, 46, or 47-- |
| Claim 29, | Column 17, | Line 59 | After the numeral "26" insert: --41, 42, 43, 44, 45, 46, or 47-- |
| Claim 30, | Column 17, | Line 61 | After the numeral "26" insert: --41, 42, 43, 44, 45, 46, or 47-- |
| Claim 31, | Column 17, | Line 67 | After the numeral "26" insert: --41, 42, 43, 44, 45, 46, or 47-- |
| Claim 33, | Column 18, | Line 20 | After the numeral "32" insert: --41, 42, 43, 44, 45, 46, or 47-- |

UNITED STATES PATENT AND TRADEMARK OFFICE

CERTIFICATE OF CORRECTION

PATENT NO. : 4,274,893

DATED : June 23, 1981

INVENTOR(S) : Mars et al.

It is certified that error appears in the above-identified patent and that said Letters Patent are hereby corrected as shown below:

| | | | |
|---|---|---|---|
| Claim 34, | Column 18, | Line 22 | After the numeral "32" insert: --41, 42, 43, 44, 45, 46, or 47-- |
| Claim 35, | Column 18, | Line 27 | After the numeral "32" insert: --41, 42, 43, 44, 45, 46, or 47-- |

Signed and Sealed this

*Nineteenth* Day of *March 1985*

[SEAL]

*Attest:*

DONALD J. QUIGG

*Attesting Officer*

*Acting Commissioner of Patents and Trademarks*